United States Patent [19]

Forestier

[11] 4,453,891

[45] Jun. 12, 1984

[54] VIBRATION DAMPING DEVICE, ESPECIALLY FOR A BLADE OF A TURBOJET ENGINE

[75] Inventor: Alexandre Forestier, Vaux le Penil, France

[73] Assignee: S.N.E.C.M.A., Paris, France

[21] Appl. No.: 392,225

[22] Filed: Jun. 25, 1982

[30] Foreign Application Priority Data

Jun. 25, 1981 [FR] France ..... 81 12459

[51] Int. Cl.[3] ..... F01D 5/10

[52] U.S. Cl. ..... 416/220 R; 416/500

[58] Field of Search ..... 416/220 R, 221, 500, 416/220 A, 222

[56] References Cited

U.S. PATENT DOCUMENTS

| | | | |
|---|---|---|---|
| 3,266,770 | 8/1966 | Harlow | 416/500 UX |
| 3,598,503 | 8/1971 | Muller | 416/221 |
| 3,723,023 | 3/1973 | Crick | 416/219 |
| 4,088,421 | 5/1978 | Hoeft | 416/500 X |

FOREIGN PATENT DOCUMENTS 2021206 11/1979 United Kingdom .

*Primary Examiner*—Charles E. Phillips
*Assistant Examiner*—Joseph M. Pitko
*Attorney, Agent, or Firm*—Oblon, Fisher, Spivak, McClelland & Maier

[57] ABSTRACT

A device is disclosed for vibration damping, especially in fans of turbojets. The root engaged inside a rotor support disk slot is kept against the upper walls of the slot under the exertion of pressure acting on the lower side of the blade root due to the present device. The device includes a torsion bar which is placed beneath the root of the blade and of which one of the ends is attached to a cam resting against the base of the root of the blade. The other end of the torsion bar is provided with a cam inserted on said bar against the base of the root of the blade under stress that was previously conveyed to the bar.

7 Claims, 6 Drawing Figures

VIBRATION DAMPING DEVICE, ESPECIALLY FOR A BLADE OF A TURBOJET ENGINE

BACKGROUND OF THE INVENTION

1. Field of the Invention

This invention concerns a vibration damping device, especially for a fan in a turbojet engine.

2. Description of the Prior Art

In some turbojet engines, the fan blades roots are mounted with play or slack inside axial dovetail slots distributed along the periphery of a support disk. At low speed, when the centrifugal force is inadequate to flatten the blade root onto the upper part of the slot, or on the ground when the fan is windmilling because of the wind, the blade roots rattle inside their slots. The rattling of the blade roots can lead to erosion of the protective rivets, a bruising of the disk notches or of the blade root and local corrosion, the above constituting deficiencies that can reduce the lifespan of parts and that can lead to the discarding of the latter, which is very expensive.

Various solutions have been put forth to remedy this deficiency which is common to all fans, such as the use of an elastic metal strip that is placed under the blade root, lining the casings under the blade platforms with synthetic foam or the use of inflatable bodies that can be placed beneath the platforms. However, those known methods do not completely remedy the above deficiencies.

SUMMARY OF THE INVENTION

According to this invention, the blade play is absorbed by a torsion bar that is placed under the blade root. One of the ends of the bar defines a cam resting against the base of the blade root, while the other extremity of the torsion bar is supported by a cam inserted on said bar and against the base of the blade root while the bar is under stress. By use of this device, the lower side of the blade root is therefore continuously subjected to pressure that keeps it resting on the upper walls of the slot.

BRIEF DESCRIPTION OF THE DRAWINGS

Various other objects, features and attendant advantages of the present invention will be more fully appreciated as the same becomes better understood from the following detailed description when considered in connection with the accompanying drawings in which like reference characters designate like or corresponding parts throughout the several views, and wherein.

DETAILED DESCRIPTION OF THE PREFERRED EMBODIMENTS

Figure 1:
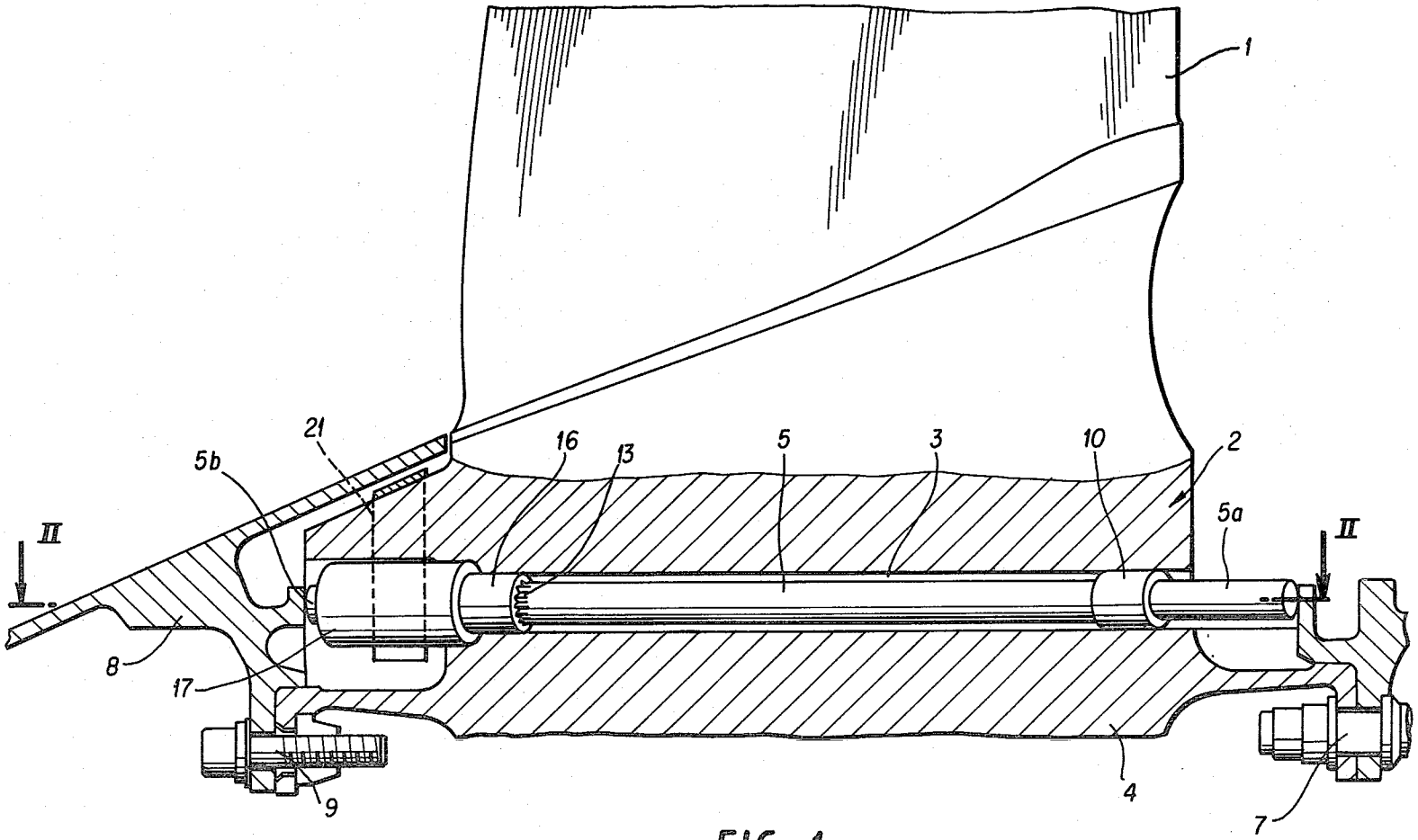
FIG. 1 is an elevated and radially sectional view of an embodiment of the vibrating damping device for fan blades of the invention.
Figure 3:
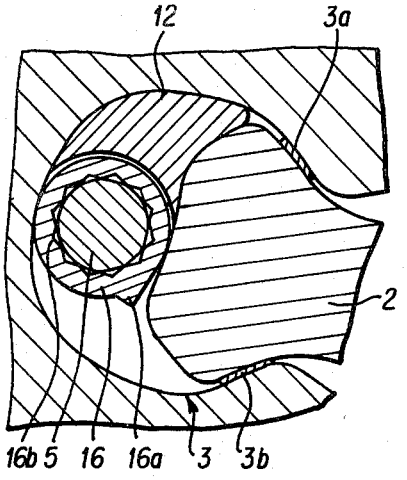
FIG. 3 is a cross-section of the device as seen along line III—III of FIG. 2.
Figure 4:
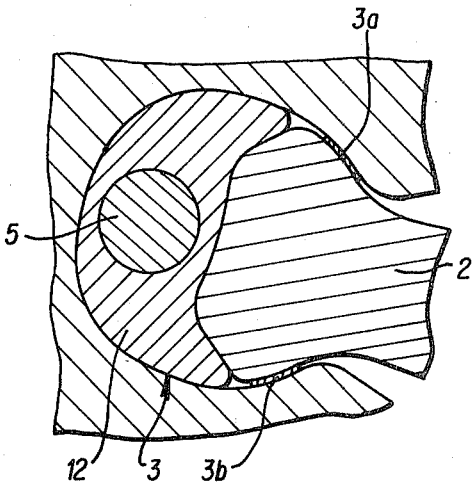
FIG. 4 is a cross-section of the device as seen along line IV—IV of FIG. 2.
Figure 5:
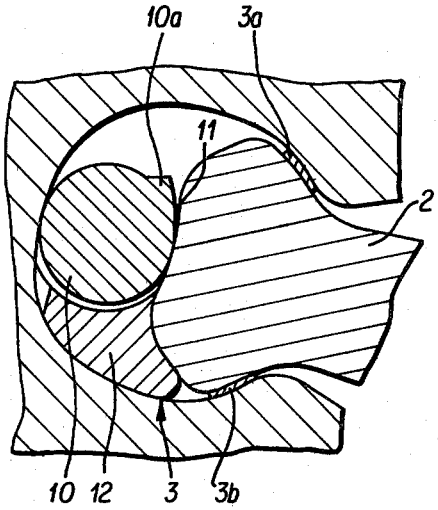
FIG. 5 is a cross-section of the device as seen along line V—V of FIG. 2.

FIG. 1 shows a fan blade 1, the root 2 of which is engaged inside and axial dovetail slot 3 (FIGS. 3, 4) defined in a rotor disc 4 of a turbojet engine fan. The lower side of the root 2 of the blade is subjected to the action of a pressure device (described below) that keeps the root pressed against the upper walls 3*a*, 3*b* (FIGS. 3 to 5) of the slot 3.

In the part of the slot 3 located beneath the root 2 of the blade there is positioned a torsion bar 5 placed (FIGS. 1, 2) lengthwise. One side of the torsion bar 5 forms a cylindrical part 5*a* which rests against an annular element 6 fixed at the rear of the disk 4 with bolts 7. The end 5*a* on the other side of the torsion bar 5 forms a part which rests against a forward cone 8 fixed on the support disk with bolts 9.

The torsion bar 5 is molded within a polymeric sleeve 12. The outer profile of the sleeve 12 corresponds to the shape of the space left open between the bottom of the slot 3 and the lower part of the blade root 2.

Furthermore, there is a side cavity formed at each end of the sleeve to permit the clearance, during assembly of cams 10 and 16 borne by the torsion bar 5, and which are described hereafter.

At one of its ends, the torsion bar 5 defines a cam 10 (FIGS. 1, 2, 5) which includes an off-center boss 10*a* which rests against the lower end 11 of the blade root, in such a way that said end of the torsion bar 5 is immobilized against rotation with respect to the blade root. At its other end, the torsion bar 5 defines two splined sections 13 and 14 (FIGS. 1, 2) separated by a smooth part 15 with a narrower section than the splined sections. On the splined section 13 is engaged a cam 16 which has a corresponding fluted hole 16*b*. The mating of the splines and flutes permits sliding but not rotation of the cam 16 with respect to the torsion bar 5, said cam 16 playing the role of a second cam which defines, like cam 10, an off-center boss 16*a* resting against the lower end of root 2 of the blade. The cam is positioned under stress that is conferred onto torsion bar 5 prior to assembly of the cam 16.

Figure 2:
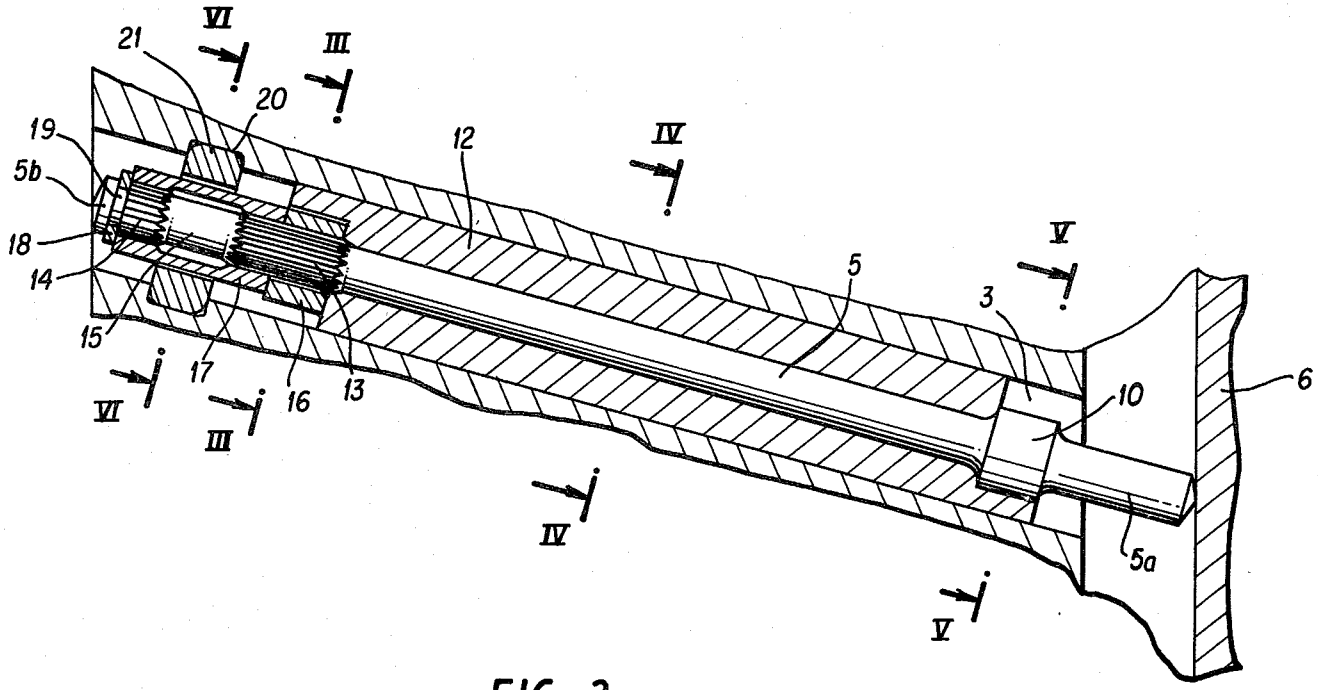
FIG. 2 is a sectional view of the device as seen along line II—II of FIG. 1.
Figure 6:
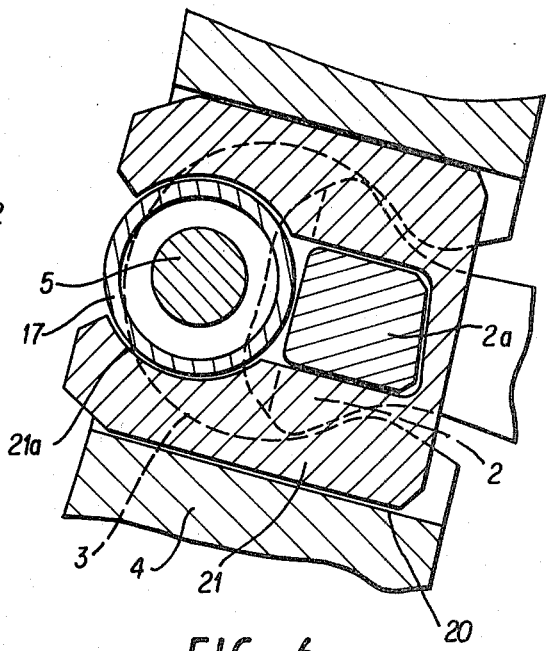
FIG. 6 is a cross-section of the device as seen along line VI—VI of FIG. 2.

On the splined sections 13 and 14 (FIGS. 1 and 2), a ring 17 is engaged which has internal flutes or grooves corresponding to the splines of the torsion bar, said ring 17 having one end resting against the cam 16 which it locks axially and on the other end resting against a split elastic ring 18 engaged inside a groove 19 formed in the end of the torsion bar. Inside rotor disk 4, near the front, a slot or slit 20 is formed inside which a bolt 21 is engaged (FIGS. 2 and 6). The bolt 21 has a U-shape which is mounted onto a part 2*a* with a reduced section of the blade root 2 (FIG. 6), said bolt 21 defining a round slot 21*a* inside which the ring 17 is engaged. This engagement radially locks the bolt 21 inside the slot 20.

The assembly of the device is as follows.

The torsion bar 5 with the sleeve 12 are mounted in the space of the slot remaining under the root 2 of the blade and the boss of the cam 10 is thrust against the lower part 11 of the blade root. The cam 16 is then slid onto the fore part of the torsion bar 5, up to the smooth part 15 of the bar.

A "left-turn" type tool is then slid on the splined part 14 of the torsion bar so that it is possible to impart torsion to the latter. The tool is maintained in that position and the cam 16 is slid from the smooth part 15 to the splined section 13, after selecting the angular position for the cam 16 which ensures a sliding contact of the boss 16*a* with the lower side of the blade root. The bar tension is thus achieved, and one can therefore remove the tool.

The U-shaped bolt 21 is then introduced into the slot 20 through the upper side of the blade. The cylindrical ring 17 is then slid onto the part 5*b* of the torsion bar, engaging inside the cut-out 21*a* of the bolt 21 and fixing the bolt radially, said ring 17 then coming into thrust position against the inserted cam 16 which it bolts axially. The ring 17 is then bolted axially by a locking ring 18.

Finally, the forward cone 8 which is set by bolts 9 is mounted on the disk 4, and which locks the entire assembly.

Obviously there are various changes that can be brought by the man skilled in the art to the devices or methods which have just been described solely as non-limiting examples, without exceeding the scope of the invention.

What is claimed as new and desired to be secured by Letters Patent of the United States is:

1. A device for absorbing play of a fan vane having a shank positionable within an axial dovetail slot of a rotor support disk, said device comprising:

a torsion bar positionable in a portion of said slot beneath the bottom of said shank;

first cam means fixed to one end of said torsion bar and resting against said shank for preventing rotation of said torsion bar relative to said shank; and second cam means fixed to a second end of said torsion bar and resting against said shank, said second cam means being fixed to said torsion bar in a position such that said torsion bar is maintained in torsional stress, wherein said second cam means comprise a casing axially slidably mounted on said second end of said torsion bar and an outwardly extending off-center boss formed on said casing, said boss resting against said shank, whereby said torsional stress presses said first and second cam means against said shank so as to absorb play of said shank relative to said slot.

2. The device of claim 1 wherein said torsion bar is held within a polymeric sleeve, the outer shape of said sleeve conforming to said portion of said slot.

3. A device for absorbing play of a fan vane having a shank positionable within an axial dovetail slot of a rotor support disk, said device comprising:

a torsion bar positionable in a portion of said slot beneath the bottom of said shank;

first cam means fixed to one end of said torsion bar and resting against said shank for preventing rotation of said torsion bar relative to said shank; and second cam means fixed to a second end of said torsion bar and resting against said shank, said second cam means being fixed to said torsion bar in a position such that said torsion bar is maintained in torsional stress, first and second axially splined portions on said second end of said torsion bar;

a smooth part on said torsion bar between said first and second splined portions, said smooth part having a diameter smaller than that of said first and second splined portions;

a splined aperture on said second cam means for axially sliding said second cam means on said torsion bar, said second cam means being positionable on said first splined portion; and a fluted locking ring simultaneously positionable on both said first and second splined portions for axially locking said second cam means on said first splined portion, whereby said torsional stress presses said first and second cam means against said shank so as to absorb play of said shank relative to said slot.

4. A device for absorbing play of a fan vane having a shank positionable within an axial dovetail slot of a rotor support disk, said device comprising:

a torsion bar positionable in a portion of said slot beneath the bottom of said shank;

first cam means fixed to one end of said torsion bar and resting against said shank for preventing rotation of said torsion bar relative to said shank; and second cam means fixed to a second end of said torsion bar and resting against said shank, said second cam means being fixed to said torsion bar in a position such that said torsion bar is maintained in torsional stress, wherein said second cam means comprise a casing axially slidably mounted on said second end of said torsion bar and an outwardly extending off-center boss formed on said casing, said boss resting against said shank, first and second axially splined portions on said second end of said torsion bar;

a smooth part on said torsion bar between said first and second splined portions, said smooth part having a diameter smaller than that of said first and second splined portions;

a splined aperture on said second cam means for axially sliding said second cam means on said torsion bar, said second cam means being positionable on said first splined portion; and a fluted locking ring simultaneously positionable on both said first and second splined portions for axially locking said second cam means on said first splined portion, whereby said torsional stress presses said first and second cam means against said shank so as to absorb play of said shank relative to said slot.

5. The device of claim 3 or 4 including:

radial slots formed in said axial slot at a position adjacent said second end of said torsion bar; and a U-shaped locking ring positionable in said radial slots with said fluted locking ring held between the branches of said U.

6. The device of claim 3 or 4 including means for axially locking said fluted locking ring, said means for axially locking comprising a ring engaged in a groove of said torsion bar.

7. The device of claim 1 or 3 or 4 including means fixed to said disk for axially positioning said torsion bar.

* * * * *